United States Patent [19]

Bühler

[11] 4,276,082

[45] Jun. 30, 1981

[54] PROCESS FOR THE HEATING AND/OR MELTING OF METALS AND AN INDUCTION FURNACE TO CARRY OUT THE PROCESS

[75] Inventor: Karl Bühler, Nussbaumen, Switzerland

[73] Assignee: BBC Brown, Boveri & Company, Limited, Baden, Switzerland

[21] Appl. No.: 119,047

[22] Filed: Feb. 6, 1980

[30] Foreign Application Priority Data

Feb. 9, 1979 [CH] Switzerland ..... 1280/79

[51] Int. Cl.[3] ..... C22D 7/00

[52] U.S. Cl. ..... 75/10 R; 13/26

[58] Field of Search ..... 13/26; 75/10; 164/51, 164/251

[56] References Cited

U.S. PATENT DOCUMENTS

| | | | |
|---|---|---|---|
| 1,837,031 | 12/1931 | Engelhardt et al. | 13/26 |
| 3,297,311 | 1/1967 | Stenkvist | 13/26 |

FOREIGN PATENT DOCUMENTS

| | | | |
|---|---|---|---|
| 344947 | 3/1931 | United Kingdom | 164/51 |
| 1036995 | 7/1966 | United Kingdom | 13/28 |

*Primary Examiner*—M. J. Andrews

*Attorney, Agent, or Firm*—Oblon, Fisher, Spivak, McClelland & Maier

[57] ABSTRACT

Apparatus and process for heating metal in an induca-tion furnace, wherein an inductor is supported above the melting charge and an alternating current is applied thereto, the inductor being supported relative to the surface of the melting charge such that the repelling effect of the electromagnetic field of the inductor holds the melting charge away from the inductor.

14 Claims, 5 Drawing Figures

PROCESS FOR THE HEATING AND/OR MELTING OF METALS AND AN INDUCTION FURNACE TO CARRY OUT THE PROCESS

BACKGROUND OF THE INVENTION

1. Field of the Invention

In the case of induction melting furnaces and holding furnaces for liquid metal, almost exclusively crucible furnaces and core-type induction furnaces dominate. The crucible furnace is predominantly used for melting, with a cooled coil surrounding the hollow, cylindrical refractory crucible. The useful heat is produced by induced currents developing in the melting charge itself. The core-type induction furnace is preferably used for the holding or maintenance of the heat and for the overheating of an already liquid melting charge. This furnace has at least one core-type inductor which is essentially a closed-core transformer where the secondary winding is formed by at least one winding of liquid metal. The metal surrounding the iron core is then enveloped by correspondingly formed refractory material and kept away from the iron core and primary winding. The inductor or coil is mostly arranged below or laterally on the outside of the furnace crucible in the area below the bath level. Solutions are also known where the coil of the core-type inductor is arranged in a tunnel-like opening in the furnace crucible whereby this opening is accessible from two sides of the furnace crucible and is surrounded by refractory material.

2. Description of the Prior Art

Two examples are shown in the brochure "Induction Smelting and Holding Furnaces" of the firm of Brown, Boveri & Cie, Aktiengesellschaft, Mannheim, undated, on Page 3, whereby the first one shows an induction crucible furnace and the second one an induction core-type furnace.

Both the induction crucible furnace as well as the induction core-type furnace have the problem that the life of the refractory lining is reduced in the area of the coils and inductors and the furnace must be emptied for repairs and also in case of deficiencies of the coils or the inductors. This is particularly, then, a disadvantage when the furnace must suddenly be emptied because of an unexpected failure of the refractory lining. The core-type furnaces are used as storages so that such an emptying means in their case a serious operation disadvantage or an expensive damage. According to experience, such damages occur comparatively often. They are caused by the fact that the refractory linings are relatively thin-walled in the area of the inductor in the case of both mentioned types of induction furnaces for economic reasons (for example, 10 to 20 cm).

The refractory lining is subjected to extreme stress owing to the intensely flowing hot metal, to temperature changes and to chemical attacks. In the case of the core-type furnace, the refractory lining has, additionally, a very unfavorable shape where it is difficult to avoid the formation of cracks.

SUMMARY OF THE INVENTION

The object of the invention is to create a process and an induction furnace with at least one inductor which does not have the disadvantage of the known systems and where the inductor can be easily removed for repair or exchanged without creating an opening in the refractory lining of the furnace crucible. The invention also makes it possible that the refractory lining of the furnace need not be made of a thin wall, owing to the coil or inductor coupling, at any point. In this way, the danger of a rupture of the lining and/or of a damage of the inductor is very much reduced.

The aforementioned object is accomplished by heating the melting charge from above by an inductor through which an alternating current flows and which is lowered into the melting charge only a depth where the rejecting power of the electromagnetic field of the inductor holds the melting charge away.

The advantage of the invention consists particularly in the fact that the arrangement of the inductor inside the boiler permits a simple manipulation of this inductor whereby no openings need to be made in the refractory lining and the refractory lining can be thin or can be omitted. In case of a possible deficiency of the inductor, it can be easily and quickly exchanged.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
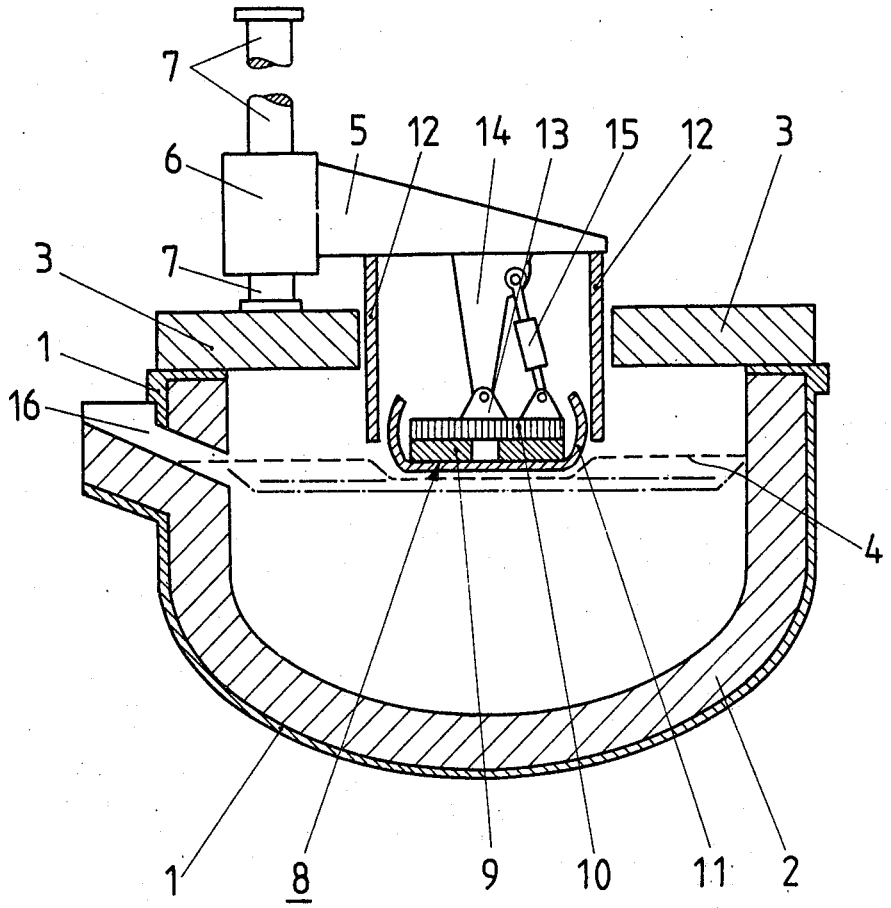
FIG. 1 is a partial cross-section through an exemplary embodiment with a flat inductor which can be adjusted as to its level as well as swiveled and is located above the bath surface.

In the drawings, wherein like reference numerals indicate like parts throughout the several views, a furnace boiler 1 is provided with a refractory lining 2 and closed with a cover 3. A bath surface is plotted in a dotted line 4. A flat inductor 8 consists of an insulated, annular coil 9, an iron core 10 and a refractory jacket 11. All constructional features not necessary for the direct understanding of the invention, for example, electric circuit for the coil 9 or a cooling arrangement for the inductor, have been omitted.

The upper part of the flat inductor 8 is surrounded by a protective jacket 12. The inductor 8 is held in a swiveling bearing 13, which is connected with a carrier plate 14. A regulating device 15 is arranged between the flat inductor 8 and the carrier plate 14, the regulating device 15 being designed as a hydraulic cylinder in this example. A discharge opening 16 is also represented in FIG. 1. The additional fastening of the flat inductor 8 is effected by means of a support 5 which is connected with a carriage 6. This carriage is mechanically, hydraulically or pneumatically guided in the vertical direction with a column sleeve 7 in a known manner. The swiveling attachment of the flat inductor 8 makes it possible to guide the inductor 8 on the bath surface 4 from the top always in the horizontal position corresponding to the bath surface 4 and to readjust it to the bath surface by swiveling during the tilting process. The refractory jacket 11 is thin because the liquid metal is repelled from the inductor 8 under the effect of the electro-magnetic alternating field. A direct contact of the refractory jacket 11 with the liquid metal can thus be almost entirely prevented.

Figure 2:
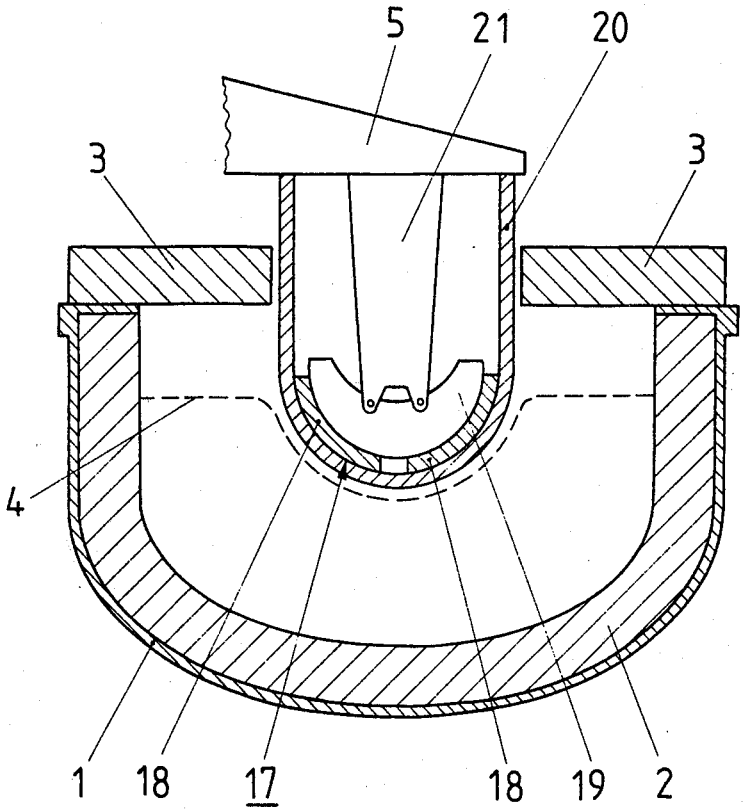
FIG. 2 is a view similar to FIG. 1 of an exemplary embodiment with a curved inductor.

The design according to FIG. 2 shows a curved inductor 17 with an insulated coil 18 and an iron yoke 19. The inductor 17 is protected by a refractory jacket 20 and connected with the support 5 by means of a fastening arrangement 21, which support 5 can be guided in vertical direction in accordance with FIG. 1. The refractory jacket 20 is comparatively thin as is the refractory jacket 11 according to FIG. 1. This inductor 17 can operate without horizontal readjustment with not too large a tilting angle of the furnace.

Figure 3:
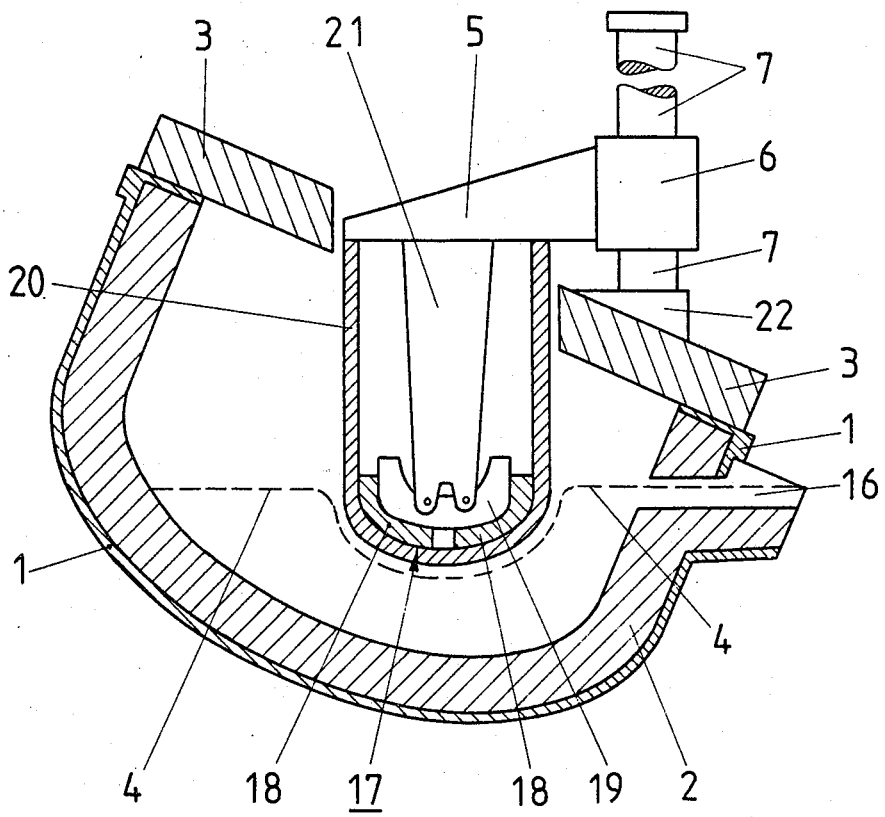
FIG. 3 is a view similar to FIGS. 1 and 2 of another variation of the arrangement of a curved inductor where the inductor is approximately in the center of the tilting range.

In FIG. 3, an additional exemplary embodiment corresponds essentially to that according to FIG. 2, but the curved inductor 17 is inclined opposite to the direction towards the discharge opening. The guiding system of the inductor 17 is actually designed in a similar way to that in FIG. 1, but the column sleeve 7 is fastened on a wedge-shaped plate 22. Thus, an inclined position of the inductor 17 is produced so that the inductor 17 is level approximately in the center of the tilting range.

Figure 4:
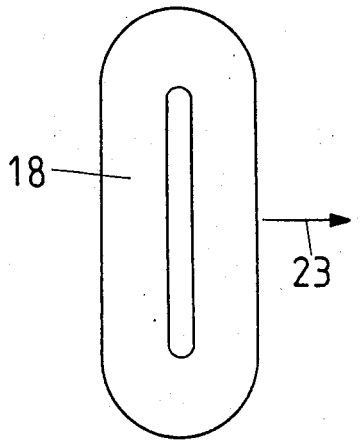
FIG. 4 is a simplified top view of the coil of the inductor according to FIG. 3.

In FIG. 4, the insulated coil 18 of FIG. 3 is shown in a top view in a simplified manner. The tilting direction of the furnace is marked by an arrow 23. The oblong shape of the coil 18 makes it possible that the distance error of the edges of the inductor 17 to the bath occurring with the tilting is not large owing to the small width of the coil 18. This constructional design makes sure of the correct operation of the inductor 17 also in the tilted condition without any readjustment.

Figure 5:
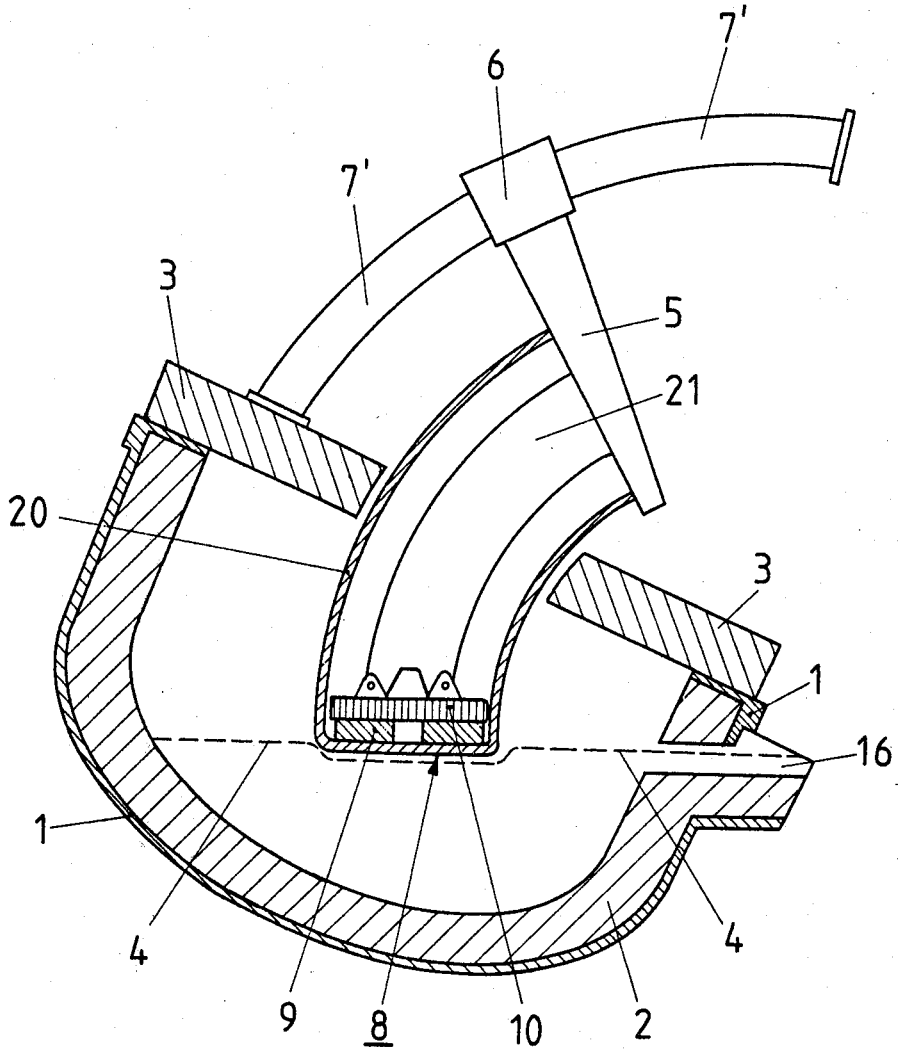
FIG. 5 is a view similar to FIG. 3 of an exemplary embodiment where the lifting device is combined with the swiveling device.

In FIG. 5, a column sleeve 7' is designed as a swiveling device. It has a circular shape whereby the center of the circle is in the area of the discharge opening 16. The column sleeve 7' can also have other expedient shapes. For example, it can have partially a straight line.

An induction furnace can also contain several inductors 8, 17. The desired coupling distance of one or several inductors towards the bath surface 4 or the immersion depth can be automatically adjusted by, for example, measuring the electrical values which are dependent on the immersion depth and forming a signal from these measured values which affects a control system adjusting the level of the inductors in a known way.

The inductors can be supplied with line frequency or center frequency. In order to achieve special agitating effects, the inductors can also be built with known traveling field windings.

In the case of the inductors not touching the metal, the refractory jacket can even be entirely omitted, whereby a more favorable coupling is obtained between the coil and the bath, besides the simplification of the construction and the increased economy.

There is also the possibility that the inductor, particularly the flat inductor 8, is designed of such a size that it fills the entire or at least almost the entire inner horizontal cross-section of the refractory lining 2 of the furnace boiler 1. In this way, it can also be prevented at a relatively high output that the metal come up.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for the heating and/or melting in an induction furnace which contains a melting charge having a surface and which contains a boiler in which there is at least one inductor having only electrically nonconductive material positioned between said conductor and said melting charge, comprising the steps of:

directly heating the melting charge from above by the inductor through which an alternating current flows, said heating resulting from the direct interaction of said alternating current and said melting charge; and lowering the inductor below said surface but only to a depth in which the rejecting power of the electro-magnetic field of the inductor caused by electric current flowing through it holds the melting charge away from the inductor.

2. A process according to claim 1, wherein at least essentially the entire bath surface is heated with the inductor.

3. A process according to claim 1, wherein the surface of the melting charge is heated over a flat area.

4. A process according to claim 1, wherein the surface of the melting charge is heated over a curved area.

5. A process according to claim 1, wherein the inductor is swiveled as the boiler is tilted to remove the molten charge therefrom.

6. A process according to claim 1, wherein the inductor is movably adjusted toward and away from the surface of the charge.

7. A process according to claim 1, wherein the inductor is inclined opposite to the direction toward a discharge opening from the boiler.

8. A process according to claim 1, wherein the inductor is moved along an arcuate path in response to tilting movement of the boiler.

9. An induction furnace for heating and/or melting of metals, comprising:

a boiler adapted to contain a metal melting charge having a surface;

at least one inductor arranged to be positioned in said boiler into proximity with said melting charge, said furnace having only electrically nonconductive matter positioned between said inductor and said melting charge;

means for maintaining a space between said inductor and said melting charge, said means for maintaining a space comprising means for supplying an alternating electric current to said inductor whereby a repulsive force is developed between said inductor and said melting charge; and means adapted to lower said inductor below said surface, said lowering means including means for limiting said lowering to a level wherein said means for maintaining a space is able to maintain said space.

10. An induction furnace according to claim 9, wherein: the inductor is a curved inductor.

11. An induction furnace according to one of claims 9 or 11, wherein: the inductor is provided with a refractory jacket and a protective jacket.

12. An induction furnace according to one of claims 9 or 11, wherein: the inductor is connected to a lifting device.

13. An induction furnace according to one of claims 9 or 11, wherein: the inductor is fastened to at least one swiveling device.

14. An induction furnace according to one of claims 9 or 11, wherein: the boiler has a discharge opening and a vertical resting position axis, and the inductor is inclined opposite to the direction towards the discharge opening so that the axis of the inductor forms an acute angle with the vertical resting position axis of the boiler.

* * * * *